United States Patent [19]

Spector

[11] Patent Number: 5,027,439

[45] Date of Patent: Jul. 2, 1991

[54] DUAL-MODE ATHLETIC GLOVE

[76] Inventor: Donald Spector, 380 Mountain Rd., Union City, N.J. 07087

[21] Appl. No.: 545,836

[22] Filed: Jun. 29, 1990

[51] Int. Cl.[5] ..... A41D 19/00

[52] U.S. Cl. ..... 2/161 A; 2/20; 2/164; 273/67 B

[58] Field of Search ..... 2/161 A, 161 R, 159, 2/164, 19, 16, 20, 167; 272/67, 68; 273/118 R, 122 R, 67 B

[56] References Cited

U.S. PATENT DOCUMENTS

| | | | |
|---|---|---|---|
| 1,072,560 | 9/1913 | Baskin | 2/159 |
| 1,083,795 | 1/1914 | Brokaw | 2/16 |
| 1,507,153 | 9/1924 | Binns | 2/159 |
| 2,025,357 | 12/1935 | Pagan | 2/161 R |
| 2,636,172 | 4/1953 | Stobbe | 2/19 |
| 2,952,021 | 9/1960 | Finn | 2/20 |
| 3,290,695 | 12/1966 | Burtoff | 2/161 R |
| 3,931,647 | 1/1976 | Dien | 2/161 A |
| 4,042,975 | 8/1977 | Elliott, Jr. et al. | 2/161 A |
| 4,051,553 | 10/1977 | Howard | 2/161 A |
| 4,071,913 | 2/1978 | Rector | 2/161 R |
| 4,095,292 | 6/1978 | Klein | 2/161 A |
| 4,617,684 | 10/1986 | Green et al. | 2/20 |
| 4,624,016 | 11/1986 | Luevano | 2/161 A |
| 4,747,163 | 5/1988 | Dzierson | 2/164 |
| 4,748,690 | 6/1988 | Webster | 2/161 A |
| 4,751,749 | 6/1988 | Cowhey | 2/164 |
| 4,864,659 | 9/1989 | Morris | 2/161 A |

FOREIGN PATENT DOCUMENTS

| | | | |
|---|---|---|---|
| 1190133 | 7/1985 | Canada | 2/161 A |

*Primary Examiner*—Werner H. Schroeder
*Assistant Examiner*—Amy Brooke Vanatta
*Attorney, Agent, or Firm*—Michael Ebert

[57] ABSTRACT

A dual mode athletic glove that includes an outer shell contoured to define a body section having finger sections radiating therefrom, the front surface of the body section forming a palm zone. Disposed within the outer shell and conforming thereto is an inner liner. A relatively stiff, flexible plate, interposed between the outer shell and the inner liner, is placed behind the palm zone as a backing therefor, whereby when the glove is worn by a player, then in its catching mode an incoming ball can be received in the palm zone and grasped by the finger sections of the glove. In the whacking mode of the glove, the finger sections are outstretched and the incoming ball is struck by the plate-backed palm zone which then functions as a paddle.

8 Claims, 2 Drawing Sheets

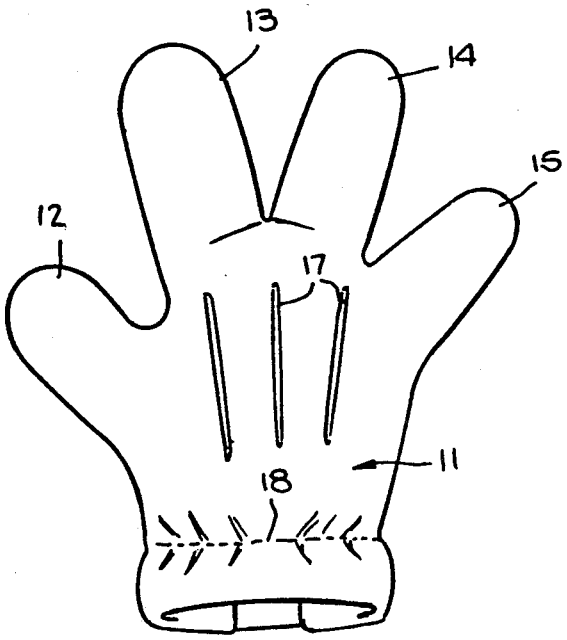
Fig. 1.
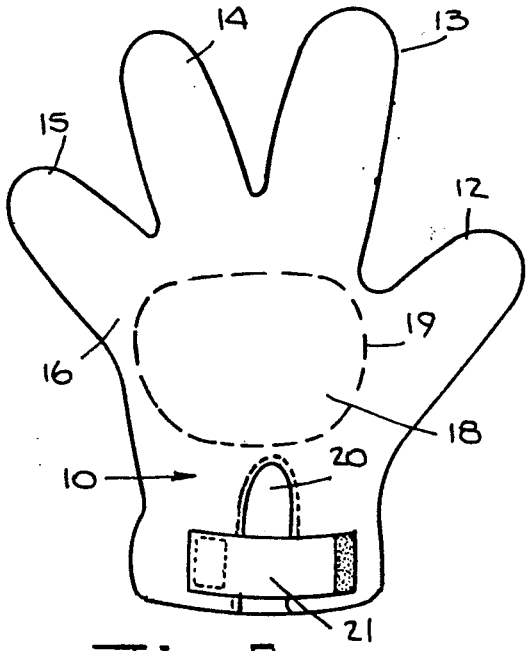
Fig. 2.
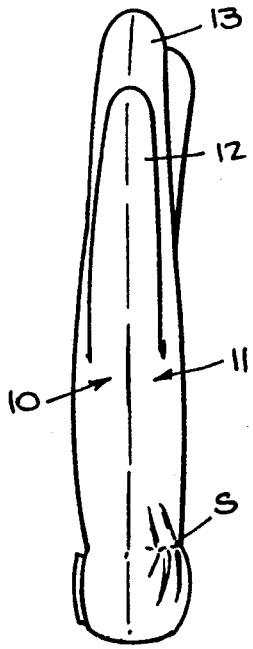
Fig. 3.
Fig. 5.
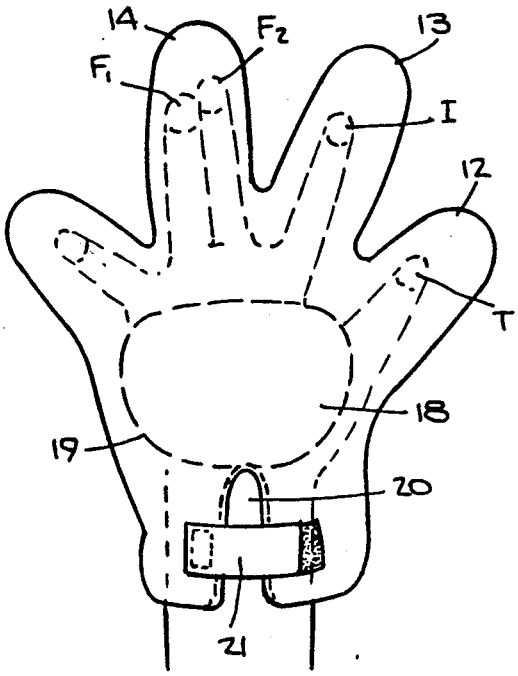
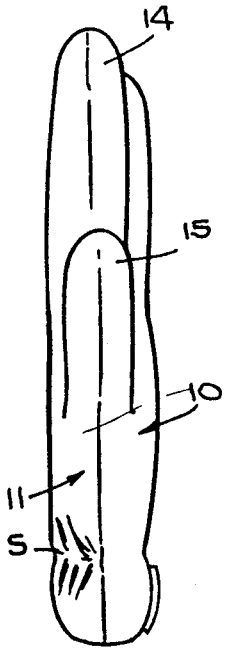
Fig. 4.

DUAL-MODE ATHLETIC GLOVE

BACKGROUND OF INVENTION

1. Field of Invention

This invention relates generally to athletic gloves, and more particularly to a dual-mode glove, which in its catching mode permits a player wearing the glove to grasp an incoming ball, and which in its whacking mode acts as a paddle to permit the player to strike the ball to cause it to rebound.

2. Status of Prior Art

The main function of an athletic glove is to protect the hand of a player and in some cases to improve the player's performance. Thus if the glove is designed to facilitate catching a ball, then the glove, as in a catcher's glove for baseball, is oversize and is adapted to cushion the hand of the player. But when a baseball player is up at bat, he will often wear a thin, tight-fitting glove to enhance his grip on the bat.

The Luevano U.S. Pat. No. 4,624,016, discloses an athletic glove which will fit snugly on the hand, the palm zone of the glove having a cushion laminated thereto to protect the hand against injury. Similarly, in the protective glove shown in the Rector patent, a thick, resilient pad is secured to the palm zone of the glove.

The Finn U.S. Pat. No. 2,952,021, discloses a cushioned handball mitt having relatively stiff backhand and forehand panels so that the player wearing the mitt can apply a racket type stroke to the ball either forehand or backhand. This mitt has no fingers and the player cannot therefore catch a ball with the mitt.

The Goebel U.S. Pat. No. 4,176,407, discloses a hitting mitt in the form of a flexible pad formed into a tube into which the player can insert his hand without impeding the use of his fingers and thumb. This mitt is intended for volleyball in which the ball itself is struck by the palm of the player's hand.

In the glove shown in the Brewer et al. U.S. Pat. No. 1,558,666, a miniature circular racket having cross strings is attached to the glove so that the glove can be used to strike a ball. A similar racket and glove combination is shown in the Rittenhouse U.S. Pat. No. 1,523,899, the ball bouncing off the resilient cross strings of the racket. But these gloves cannot be used to catch a ball.

The present invention seeks to enlarge the play possibilities of a play ball of the type disclosed in my prior Spector U.S. Pat. No. 4,834,382. This play ball is constituted by an outer, non-stretchable flexible casing within which is a rubber balloon which is inflated to conform to the inner surface of the casing. In a rubber balloon which is inflated within the confines of a casing, the internal pressure therein is relatively high as compared to an inflated bladder whose molded shape matches that of the outer casing. Hence the play ball is much bouncier than a convention pneumatic play ball.

With a balloon-type play ball, the players can catch the ball or throw it with their bare hands. And they can also strike the ball with the palms of their hands. But with young children, in the heat of a game in which the ball goes back and forth quickly between the players, these actions may be painful and even result in minor injuries to the unprotected hands.

While a dual-mode glove in accordance with the invention is especially useful when used to play with a balloon-type play ball, the glove is by no means limited to this application, for the glove is useful with any type of ball, such as a ball formed of flexible foam, synthetic plastic material, in which the glove in one mode serves to protect the hand when catching the ball, and in another mode functions as a paddle to whack or strike the ball.

SUMMARY OF INVENTION

In view of the foregoing, the main object of this invention is to provide a dual-mode athletic glove adapted in one mode to protect the hand of a player when catching an incoming ball and to facilitate catching of relatively large diameter balls, and in another mode acts as a paddle to whack the incoming ball to cause it to rebound.

Also an object of this invention is to provide a glove of the above type which has only four finger sections so that when worn by the player, it transforms the hand into a fanciful science fiction or extraterrestrial hand that is appealing to young children.

Still another object of the invention is to provide a dual-mode glove that may be mass-produced at low cost and which functions to cushion the hand.

Briefly stated, these objects are attained in a dual mode athletic glove that includes an outer shell contoured to define a body section having finger sections radiating therefrom, the front surface of the body section, forming a palm zone. Disposed within the outer shell and conforming thereto is an inner liner. A relatively stiff, flexible plate, interposed between the outer shell and the inner liner, is placed behind the palm zone as a backing therefor, whereby when the glove is worn by a player, then in its catching mode an incoming ball can be received in the palm zone and grasped by the finger sections of the glove. In the whacking mode of the glove, the finger sections are outstretched and the incoming ball is struck by the plate-backed palm zone which then functions as a paddle.

BRIEF DESCRIPTION OF DRAWINGS

For a better understanding of the invention as well as other objects and further features thereof, reference is made to the following detailed description to be read in conjunction with the accompanying drawings, wherein:

FIG. 1 is a rear view of a dual-mode glove in accordance with the invention;

FIG. 2 is a front view of the glove;

FIG. 3 is a side view of the glove on one side thereof;

FIG. 4 is a side view on the other side of the glove;

FIG. 5 is a front view of the glove showing in dotted lines a player's hand received therein;

DESCRIPTION OF INVENTION

Figure 7:
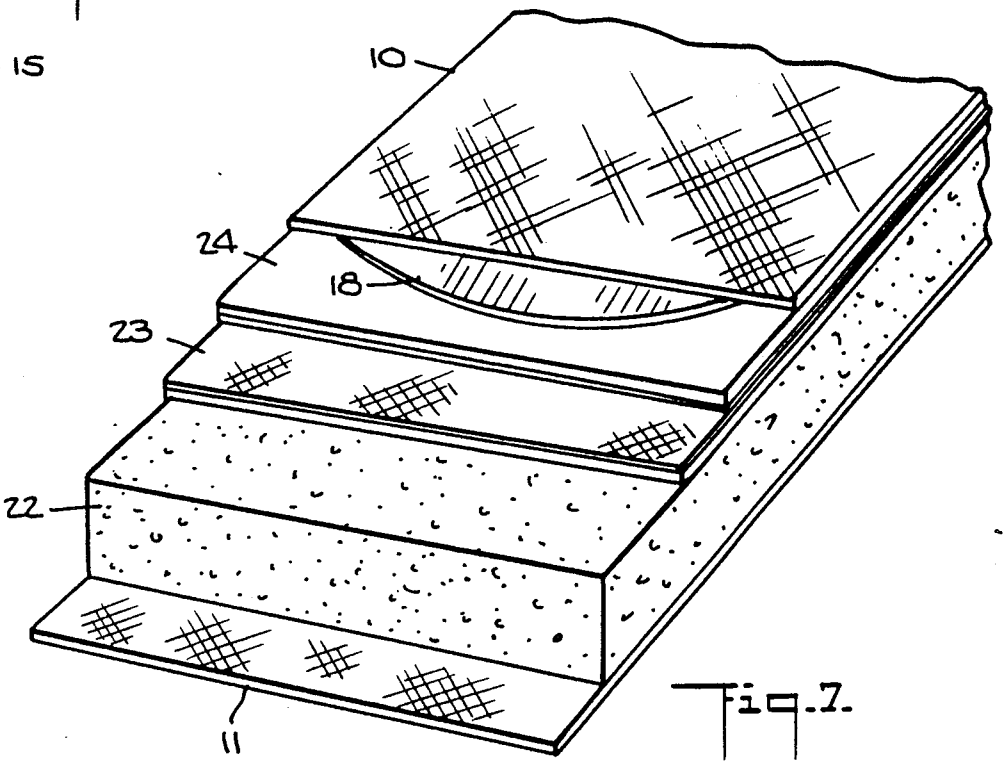
FIG. 7 illustrates the components which form the glove.
Figure 6:
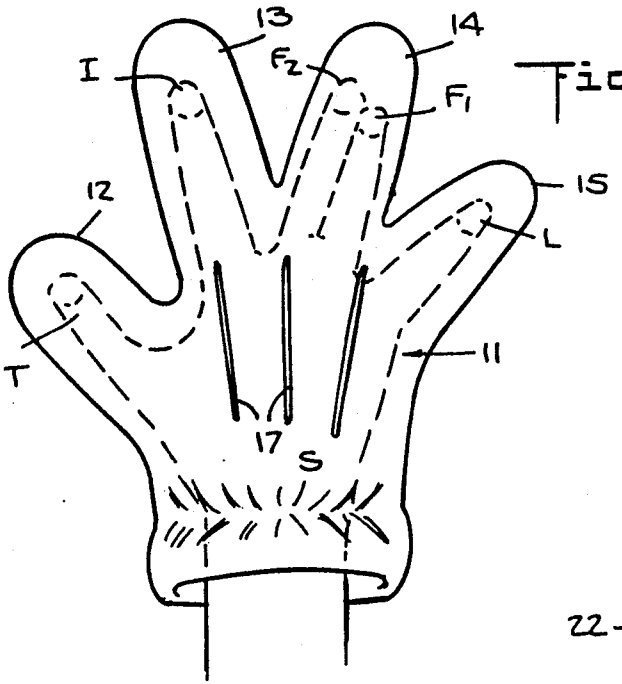
FIG. 6 is a rear view of the glove also showing the hand therein.

Referring now to FIGS. 1 to 6, a dual-mode athletic glove in accordance with the invention includes an outer shell formed by front and rear fabric sheets 10 and 11. These sheets are die cut or otherwise contoured and are seamed together at their contoured edges to define four finger sections 12, 13, 14 and 15 and a body section 16 from which the finger sections radiate.

The glove shown in the figures is a right hand glove, and finger section 12 is adapted to receive the thumb T of the player's right hand, finger section 13 receiving index finger I, finger section 14 receiving both intermediate fingers $F_1$ and $F_2$, and finger section 15 receiving the little finger or pinkie L.

Because the athletic glove has four, not five, finger sections, and is relatively large or massive compared to the hand of the child who puts this glove on, the glove has the appearance of a four-fingered circus clown glove or the fanciful hand of a science fiction character. Hence the glove, even when not used to play ball, has a play value.

The rear fabric sheet 11 in the body section of the glove includes ribs 17 sewn along this sheet. Below ribs 17 and parallel to the opening of the glove is a line of elastic stitching S, causing sheet 11 to pucker at the wrist of the wearer.

Figure 8:
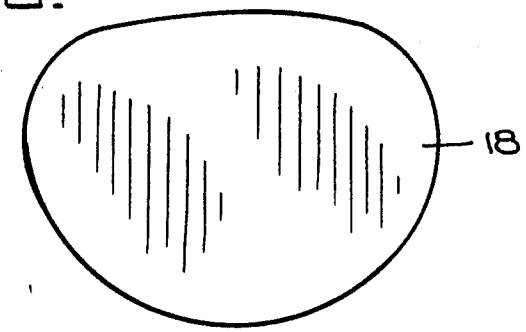
FIG. 8 is a separate view of the stiff panel incorporated in the glove.

The front fabric sheet 10 in the body section 16 includes a palm zone 18 behind which is a thin, flexible plate or panel 19 formed of synthetic plastic material, such as polypropylene. Though it is flexible, panel 19 is relatively stiff and acts as a paddle or bat. As shown separately in FIG. 8, panel 19 is somewhat oval in form, the upper arch having a smaller radius than the lower arch. Panel 19 is so placed as to overlie the palm P of the player's hand inserted in the glove.

The front of the body section of the glove at its opening is provided with a V-shaped indentation 20 which divides the front into two parts. These are held together by a Velcro fastener 21 which can be adjusted to more or less draw the two parts together to fit the glove to the wearer's hand.

As shown in FIG. 7, the structure of the glove whose outer shell is formed by the front and rear fabric sheets 10 and 11, includes an inner liner formed by front and rear laminated-fabric layers 23 and 24 whose contours are similar to those of the front and rear fabric sheets. Layers 23 and 24 are seamed together at their edges to define a liner within the glove to accommodate the right hand of the player. Layers 23 and 24 are preferably composed of a thin, flexible plastic core laminated to fabric skins.

Interposed between rear layer 23 of the inner liner and rear fabric sheet 11 of the outer shell and similarly contoured is a relatively thick cushioning pad 22 of flexible foam plastic material. This pad lends body to the glove so that the finger sections thereof are normally outstretched. Panel 19 is interposed between front layer 24 of the inner liner and front sheet 10 of the outer shell and is placed behind the palm zone of the glove.

A left-hand glove may be provided that in all respects other than its finger relationship is identical to the right hand glove shown. Thus in catching a large-diameter ball, the ball is caught between the palm zones of the two gloves, with the finger sections of the gloves grasping the surface of the ball. For this purpose, it is not necessary to use two gloves, for a glove may be worn on only one hand to receive the impact of an incoming ball, and the ball is then grasped by the finger sections of the glove and the fingers of the naked hand of the player. The advantage of using gloves, apart from the fact that they protect the hands of the players, is that they effectively enlarge the player's hands, making it possible to grasp large diameter balls.

But when the glove is to be used as a paddle to whack an incoming ball to cause it to rebound, then the finger sections are outstretched and the ball is struck by the backed palm of the glove. By wearing two gloves, the player can strike the ball with either glove. This makes for a faster game; for when each of the players wears gloves on both hands, then they have an ability to whack an incoming ball regardless of whether it is coming directly toward the player or to either side of the player.

While there has been shown and described a preferred embodiment of a dual-mode athletic glove in accordance with the invention, it will be appreciated that many changes and modifications may be made therein without, however, departing from the essential spirit thereof. Thus in practice, the outer shell of the glove may be coated with a phosphorescent material to cause the glove to glow in the dark. Because of the glove's size, a glowing glove on the hands of a small child has a dramatic impact on viewers, for now the child appears to have the hands of an extraterrestrial creature from outer space.

I claim:

1. A dual-mode athletic glove comprising:

(a) an outer shell formed by a front sheet peripherally joined to a rear sheet and contoured to define a body section having a palm zone on the front sheet, and finger sections radiating from the body section;

(b) an inner liner disposed within the outer shell and conforming thereto, said inner liner being formed by a front layer and a rear layer;

(c) a pad of resilient material interposed between the rear layer of the inner liner and the rear sheet of the outer shell, said pad being contoured to conform to the outer shell and to impart body to the glove whereby the finger sections thereof are normally outstretched; and (d) a relatively stiff, flexible flat plate interposed between the front sheet and the front layer and placed behind the palm zone, whereby when the glove is worn by a player, then in its catching mode an incoming ball can be received in the palm zone and grasped by the finger sections of the glove which are then flexed by the player, while in its whacking mode, the finger sections are in their normally outstretched state and the incoming ball is struck by the plate-backed palm zone which then functions as a paddle.

2. A glove as set forth in claim 1, wherein four finger sections are provided, the first for the thumb of a player's hand, the second for the index finger, the third for both intermediate fingers, and the fourth for the small finger.

3. A glove as set forth in claim 1, wherein the front of the glove body section at its hand opening is provided with a V-shaped indentation forming two parts that are more or less drawn together to fit the hand of the player by a Velcro fastener.

4. A glove as set forth in claim 1, wherein said pad is formed of flexible, foam plastic material.

5. A glove as set forth in claim 1, wherein said outer shell is formed by sheets of fabric material.

6. A glove as set forth in claim 1, wherein the layers which form the inner liner are formed by a thin core of flexible foam plastic material laminated to fabric skins.

7. A glove as set forth in claim 1, further including below said palm zone a stitched line of elastic threading to pucker the front sheet.

8. A glove as set forth in claim 1, wherein said plate is formed of synthetic plastic material and has rounded corners.

* * * * *